US005155089A

United States Patent [19]

Etzbach et al.

[11] Patent Number: 5,155,089

[45] Date of Patent: Oct. 13, 1992

[54] ANTHRAQUINONE DYES FOR THERMAL TRANSFER PRINTING

[75] Inventors: Karl-Heinz Etzbach, Frankenthal; Ruediger Sens, Mannheim, both of Fed. Rep. of Germany

[73] Assignee: BASF Aktiengesellschaft, Ludwigshafen, Fed. Rep. of Germany

[21] Appl. No.: 789,308

[22] Filed: Nov. 8, 1991

[30] Foreign Application Priority Data

Dec. 14, 1990 [DE] Fed. Rep. of Germany ..... 4039923

[51] Int. Cl.[5] ..... B41M 5/035; B41M 5/26

[52] U.S. Cl. ..... 503/227; 428/195; 428/913; 428/914

[58] Field of Search ..... 8/471; 428/195, 913, 428/914; 503/227

[56] References Cited

FOREIGN PATENT DOCUMENTS

| | | | |
|---|---|---|---|
| 0056492 | 7/1982 | European Pat. Off. | 503/227 |
| 0111004 | 6/1984 | European Pat. Off. | 503/227 |
| 0133011 | 2/1985 | European Pat. Off. | 503/227 |
| 0133012 | 2/1985 | European Pat. Off. | 503/227 |
| 0192435 | 6/1986 | European Pat. Off. | 503/227 |
| 0216483 | 4/1987 | European Pat. Off. | 503/227 |
| 0227092 | 7/1987 | European Pat. Off. | 503/227 |
| 0227094 | 7/1987 | European Pat. Off. | 503/227 |
| 0227095 | 7/1987 | European Pat. Off. | 503/227 |
| 3426093 | 1/1986 | Fed. Rep. of Germany | 503/227 |
| 3812053 | 10/1989 | Fed. Rep. of Germany | 503/227 |
| 2035130 | 12/1970 | France . | |
| 61-127392 | 6/1986 | Japan | 503/227 |

OTHER PUBLICATIONS

Patent Abstracts of Japan, vol. 11, No. 155(M-589)[2602], May 20, 1987, & JP-A-61-284489, Dec. 15, 1986, T. Suzuki, et al., "Thermal Transfer Sheet".

Patent Abstracts of Japan, vol. 13, No. 36(M-790)[3384], Jan. 26, 1989, & JP-A-63-246284, M. Nishikuri, et al., "Cyan Coloring Matter for Sublimation Transfer Type Thermal Recording".

Patent Abstracts of Japan, JP-103386, Jun. 9, 1983, JP-A-59-227-948, Dec. 21, 1984.

Patent Abstracts of Japan, JP-161275, Sep. 2, 1983, JP-A-60-053-563, Mar. 27, 1985.

Patent Abstacts of Japan, JP-039936, Feb. 28, 1985, JP-A-61-199-997, Sep. 4, 1986.

Patent Abstracts of Japan, JP-125468, Jun. 10, 1985, JP-A-61-283-595, Dec. 13, 1986.

Patent Abstracts of Japan, JP-080006, Apr. 15, 1985, JP-A-61-237-694, Oct. 22, 1986.

*Primary Examiner*—Bruce H. Hess

*Attorney, Agent, or Firm*—Oblon, Spivak, McClelland, Maier & Neustadt

[57] ABSTRACT

Anthraquinone dyes I useful for thermal transfer printing have the formula

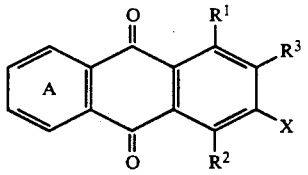

I

3 Claims, No Drawings

ANTHRAQUINONE DYES FOR THERMAL TRANSFER PRINTING

The present invention relates to the use of anthraquinone dyes of the formula

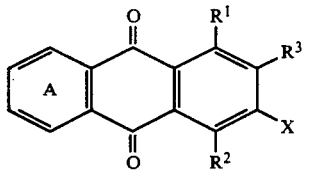

I in which the variables have the following meanings:

the ring A may carry up to two of the following substituents: chlorine, bromine, hydroxyl, capto, amino or $C_1$–$C_8$-alkylamino, $R^1$ and $R^2$ are each hydrogen, nitro, hydroxyl, mercapto, amino or $C_1$–$C_{20}$-alkoxy, -alkylthio or -alkylamino whose carbon chain may in each case be interrupted by from 1 to 4 oxygen atoms and which may each carry the following substituents: $C_5$–$C_7$-cycloalkyl, phenyl or phenoxy, which may each carry $C_1$–$C_4$-alkyl or -alkoxy as substituents, phenoxy, phenylthio or phenylamino whose phenyl moiety may carry $C_1$–$C_4$-alkyl or -alkoxy as substituents, $R^3$ is one of the radicals of the formulae IIa to IIf

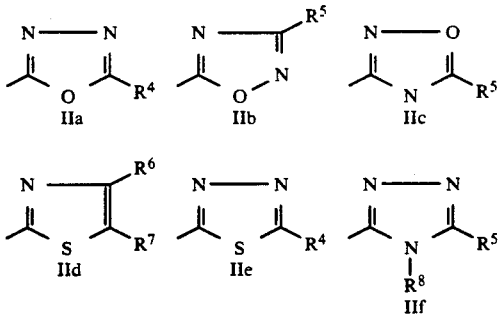

where the substituents have the following meanings:

$R^4$ is hydrogen, $C_1$–$C_{20}$-alkyl or -alkylthio whose carbon chain may in each case be interrupted by from 1 to 4 oxygen atoms in ether function and which may carry the following substituents: $C_5$–$C_7$-cycloalkyl, phenyl or phenoxy, which may each carry $C_1$–$C_4$-alkyl or -alkoxy as substituents, $C_5$–$C_7$-cycloalkyl or -cycloalkylthio or phenyl which may each carry $C_1$–$C_4$-alkyl or -alkoxy as substituents, $R^5$ and $R^8$ are each hydrogen or alkyl, cycloalkyl or phenyl $R^4$ as defined, $R^6$ and $R^7$ are each $R^5$ or $R^8$, alkoxycarbonyl whose carbon chain may have up to 20 carbon atoms and which may be interrupted by from 1 to 4 oxygen atoms in ether function and which may carry the following substituents: $C_5$–$C_7$-cycloalkyl, phenyl or phenoxy, which may each carry $C_1$–$C_4$-alkyl or -alkoxy as substituents, $C_5$–$C_7$-cycloalkyloxycarbonyl or phenoxycarbonyl which may each carry $C_1$–$C_4$-alkyl or -alkoxy as substituents, and X is hydrogen or cyano, for thermal transfer printing and specifically to a process for transferring these anthraquinone dyes from a transfer to a plastic-coated medium by diffusion with the aid of a thermal printing head.

The technique of thermal transfer printing is common knowledge; possible heat sources besides lasers and IR lamps are in particular thermal printing heads which are capable of emitting short heating pulses lasting fractions of a second.

In this preferred form of thermal transfer printing, a transfer sheet which contains the dye to be transferred together with one or more binders, a substrate material and possibly further assistants such as release agents or crystallization inhibitors is heated by the thermal printing head from the back. This causes the dye to migrate out of the transfer sheet and diffuse into the surface coating of the receiving medium, for example into the plastics coating of a sheet of coated paper.

The essential advantage of this process is that the amount of dye transferred, and hence the color gradation, can be controlled via the energy to be supplied to the thermal printing head.

Thermal transfer printing generally involves the use of the three subtractive primaries yellow, magenta and cyan with or without black, to which the dyes used must have the following properties for optimal color recording: ready thermal transferability, low tendency to migrate within or out of the surface coating of the recording medium at room temperature, high thermal and photo-chemical stability and resistance to moisture and chemicals, no tendency to crystallize out on storage of the transfer sheet, a suitable hue for subtractive color mixing, a high molar absorption coefficient, and ready industrial accessibility.

These requirements are very difficult to meet at one and the same time. For this reason most of the cyan dyes used for thermal transfer printing do not have the required property profile. This is also true of the 1,4-diaminoanthraquinones disclosed in and recommended for thermal transfer printing by JP-A-227 948/1984, JP-A-53 563/1985 and DE-A-38 12 053, which differ from the compounds of the formula I in the nature of the substituents in the 2-position.

It is an object of the present invention to provide cyan dyes suitable for thermal transfer printing which come closer to the required property profile than the prior art dyes.

We have found that this object is achieved by the anthraquinone dyes I defined at the beginning The present invention accordingly provides a process for transferring anthraquinone dyes by diffusion from a transfer to a plastic-coated medium with the aid of a thermal printing head, which comprises using for this purpose a transfer on which there is or are one or more anthraquinone dyes I.

In a preferred embodiment of this process, the dyes used have the formula Ia

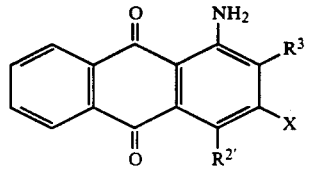

Ia where the substituents $R^1$ and X are each as defined at the beginning and $R^{2'}$ is amino or $C_1$–$C_8$-alkylamino.

The anthraquinone dyes I themselves are known per se or obtainable by known methods (EP-A-56 492 and DE-A-34 26 093).

The ring A is preferably unsubstituted, but may also carry up to two of the following substituents: chlorine, bromine, mercapto and also preferably hydroxyl and amino, further $C_1$-$C_8$-alkylamino such as pentylamino, hexylamino, heptylamino and octylamino and in particular $C_1$-$C_4$-alkylamino such as methylamino, ethylamino propylamino, isopropylamino and butylamino.

Suitable $R^1$ and $R^2$ are nitro and mercapto, in particular hydrogen and especially hydroxyl and amino.

Further suitable $R^1$ and $R^2$ are alkoxy, alkylthio and in particular alkylamino groups which contain up to 20, preferably up to 8, carbon atoms and whose carbon chain may be additionally interrupted by oxygen atoms in ether function; examples are (Ph=phenyl):

—O—$CH_3$, —O—$C_2H_5$, —O—$C_3H_7$, —O—CH(CH-3)—$CH_3$, —O—$C_4H_9$ and —O—$C_6H_{13}$;

—S—$CH_3$, —S—$C_2H_5$, —S—$C_3H_7$, —S—$C_4H_9$, —S—$C_9H_{19}$ and —S—$(CH_2)_4$—CH($C_4H_9$)—$C_5H_{11}$;

—NH—$CH_3$, —NH—$C_2H_5$, —NH—$C_3H_7$, —NH—CH($CH_3$)—$CH_3$, —NH—$C_4H_9$, —NH—$C_5H_{11}$, —NH—$C_6H_{13}$ and —NH—$C_8H_{17}$;

—$[(CH_2)_2$—O$]_2$—$CH_3$, —$[(CH_2)_2$—O$]_2$—$C_3H_7$, —$[(CH_2)_3$—O$]_3$—$C_4H_9$, —$[(CH_2)_2$—O$]_4$—$CH_3$, —$[(CH_2)_2$—O$]_2$—Ph, —$[(CH_2)_2$—O$]_3$—Ph, —$[(CH_2)_2$—O$]_3$—Ph—3—$CH_3$, —$[(CH_2)_2$—CH($CH_3$)—O$]_2$—$C_2H_5$, —$[(C_2H_4)_2$—$C_2H_5$, —$[(CH_2)_3$—O$]_4$—$C_6H_{13}$, —$[(CH_2)_2$—O$]_2$—$[(CH_2)_3$—O$]_2$—$C_2H_5$ and —$(CH_2)_3$—O—$(CH_2)_2$—O—Ph; —S—$(CH_2)_3$—O—$(CH_2)_4$—CH($C_2H_5$)—$C_4H_9$ and —S$(CH_2)_3$—O—$(CH_2)_2$—O—$C_4H_9$; —NH—$(CH_2)_2$—O—$C_4H_9$ and —NH—$[(CH_2)_2$—O$]_2$—$C_2H_5$.

$R^1$ and $R^2$ may each also be phenoxy, phenylthio or phenylamino; examples are:

—O—Ph, —O—Ph—2—$CH_3$, —O—Ph—4—$CH_3$, —O—Ph—2—O—$CH_3$ and —O—Ph—4—O—$CH_3$;

—S—Ph, —S—Ph—2—$CH_3$, —S—Ph—4—$CH_3$, —S—Ph—2—O—$CH_3$ and —S—Ph—4—O—$CH_3$;

—NH—Ph, —NH—Ph—2—$CH_3$, —NH—Ph—4—$CH_3$, —NH—Ph—2—O—$CH_3$ and —NH—Ph—4—O—$CH_3$.

Suitable $R^3$ besides the oxadiazole derivatives of the formulae IIb and IIc and the triazole derivatives of the formula IIf includes in particular the oxadiazole derivatives of the formula IIa, the thiazole derivatives of the formula IId and the thiadiazole derivatives of the formula IIe.

In these formulae, suitable alkyl $R^4$ is for example methyl, ethyl, propyl, isopropyl, butyl, isobutyl, secbutyl, tert-butyl, pentyl, isopentyl, secpentyl, tert-pentyl, hexyl, 2-methylpentyl, heptyl, octyl, 2-ethylhexyl, nonyl, decyl, undecyl, dodecyl, tridecyl, tetradecyl, pentadecyl, hexadecyl, heptadecyl, octadecyl, nonadecyl, icosyl and branched radicals of this kind.

The carbon chain of said alkyl $R^4$ may be interrupted by oxygen atoms in ether function. Examples thereof, in addition to the oxaalkyl groups mentioned above for the radicals $R^1$ and $R^2$, are the following radicals:

—$(CH_2)_2$—O—$CH_3$, —$(CH_2)_2$—O—$C_2H_5$, —$(CH_2)_2$—O—$C_3H_7$, —$(CH_2)_2$—O—$C_4H_9$, —$(CH_2)_3$—O—$CH_3$, —$(CH_2)_3$—O—$C_2H_5$, —$(CH_2)_3$—O—$C_3H_7$, —$(CH_2)_3$—O—$C_4H_9$, —$CH_2$—CH($CH_3$)—O—$CH_3$, —$CH_2$—CH($CH_3$)—O—$C_2H_5$, —$CH_2$—CH($CH_3$)—O—$C_3H_7$, —$CH_2$—CH($CH_3$)—O—$C_4H_9$, —$(CH_2)_4$—O—$CH_3$, —$(CH_2)_4$—O—$C_2H_5$, —$(CH_2)_4$—O—$C_4H_9$, —$(CH_2)_4$—O—$CH_2$—CH($C_2H_5$)—$C_4H_9$, —$(CH_2)_5$—O—$CH_3$ and —$(CH_2)_8$—O—$C_4H_9$.

$R^4$ can also be alkylthio as mentioned for $R^1$ and $R^2$.

Suitable cycloalkyl, cycloalkylthio or phenyl $R^4$ is for example (where $C_5H_9$=cyclopentyl and $C_6H_{11}$=cyclohexyl):

—$C_5H_9$, —$C_6H_{11}$, —$C_6H_{10}$—4—$CH_3$ and —$C_6H_{10}$—4—O—$C_2H_5$;

—S—$C_6H_{11}$;

—Ph, —Ph—3—$CH_3$ and —Ph—4—$CH_3$.

Suitable $R^5$, $R^8$, $R^6$ and $R^7$ are in addition to the cycloalkyl and phenyl groups mentioned for $R^4$ in particular the alkyl groups likewise mentioned there.

Suitable $R^6$ and $R^7$ are in particular alkoxycarbonyl groups whose carbon chains may be interrupted by oxygen atoms in ether function, but also cycloalkyloxycarbonyl and phenoxycarbonyl groups; examples of these groups are as follows:

—CO—O—$C_6H_{13}$, —CO—O—$C_{10}H_{21}$ and —CO—O—$C_{11}H_{23}$;

—CO—O—$[(CH_2)_2$—O$]_3$—$C_3H_7$, —CO—O—$[(CH_2)_2$—O$]_3$—$C_4H_9$, —CO—O—$[(CH_2)_3$—O$]_2$—$C_4H_9$ and —CO—O—$[(CH_2)_3$—O$]_3$—$C_4H_9$;

—CO—O—$C_6H_{11}$ and —CO—O—Ph.

Preferred anthraquinone dyes I are given in the Examples.

Compared with the cyan dyes hitherto used for thermal transfer printing, the anthraquinone dyes I to be used according to the present invention have the following properties: readier thermal transferability despite the relatively high molecular weight, improved migration properties in the recording medium at room temperature, higher light fastness, better resistance to moisture and chemicals, better solubility in the preparation of the printing ink, higher color strength, higher cleanness of hue and readier industrial accessibility.

Moreover, the dyes I, alone or combined with other classes of dyes, give neutral, strong black prints.

The transfer sheets required as dye donors for the thermal transfer process of the present invention are prepared as follows. The anthraquinone dyes I are incorporated in an organic solvent, eg. isobutanol, methyl ethyl ketone, methylene chloride, chlorobenzene, toluene, tetrahydrofuran or a mixture thereof, with one or more binders and possibly further assistants such as release agents or crystallization inhibitors to form a printing ink in which the dyes are preferably present in a molecularly dispersed, ie. dissolved, form. The printing ink is then applied to an inert substrate and dried.

Suitable binders for this purpose are all materials which are soluble in organic solvents and known to be useful for thermal transfer printing, eg. cellulose derivatives such as methylcellulose, hydroxypropylcellulose, cellulose acetate or cellulose acetobutyrate, in particular ethylcellulose, ethylhydroxyethylcellulose and cellulose acetate hydrogen phthalate, starch, alginates, alkyd resins and vinyl resins such as polyvinyl alcohol or polyvinylpyrrolidone and also in particular polyvinyl acetate and polyvinyl butyrate. It is also possible to use polymers and copolymers of acrylates or their derivatives, such as polyacrylic acid, polymethyl methacrylate or styrene-acrylate copolymers, polyester resins, polyamide resins, polyurethane resins or natural resins such as gum arabic.

The binders mentioned hold the dye, after the printing ink has dried, in the form of a transparent film in which no visible crystallization of the dye occurs.

Preferred binders are ethylcellulose or ethylhydroxyethylcellulose in medium to low viscosity formulations. Frequently it is also advisable to use binder mixtures, for example those of ethylcellulose and polyvinyl butyrate in a weight ratio of 2:1.

The weight ratio of binder to dye ranges in general from 8:1 to 1:1, preferably from 5:1 to 2:1.

The assistants used are for example release agents based on perfluorinated alkylsulfonamidoalkyl esters or silicones as described in EP-A-227 092 and EP-A-192 435, and in particular organic additives which prevent the transfer dyes from crystallizing out in the course of storage and heating of the inked ribbon, for example cholesterol or vanillin.

Inert substrate materials are for example tissue, blotting or parchment paper and films made of heat resistant plastics such as polyesters, polyamides or polyimides, which films which may also be metal-coated The inert substrate may additionally have on the side facing the thermal printing head a lubricant layer to prevent sticking of the thermal printing head to the substrate material Suitable lubricants are for example silicones or polyurethanes as described in EP-A-216 483 and EP-A-227 095.

The thickness of the substrate is in general from 3 to 30 μm, preferably from 5 to 10 μm.

The medium to be printed, eg. paper, must in turn have a coating of a binder which takes up the dye on printing. The materials used for this purpose are preferably polymeric materials whose glass transition temperatures $T_s$ are below 150° C., eg. modified polycarbonates and polyesters. Further details may be found in EP-A-227 094, EP-A-133 012, EP-A-133 011, EP-A-111 004, JP-A-199 997/1986, JP-A-283 595/1986, JP-A-237 694/1986 and JP-A-127 392/1986.

The process of the present invention is carried out using a thermal printing head which is heatable to above 300° C., so that transfer of the dye takes place within a period of not more than 15 msec.

EXAMPLES

First, transfer sheets (donors) were prepared in a conventional manner from 8 μm thick polyester film, coated with an approximately 5 μm thick transfer layer of a binder B which in each case contained 0.5 g of anthraquinone dye I. The weight ratio of binder to dye was in each case 2:1.

The medium to be printed (receptor) was paper of approximately 120 μm thickness which had been coated with an 8 μm thick plastics layer (Hitachi Color Video Print Paper).

Donor and receptor were placed on top of one another with the coated sides next to each other, wrapped in aluminum foil and heated between two hot plates at 70°–80° C. for 2 minutes. This operation was repeated three times on similar samples at ever higher temperatures within the range from 80° to 120° C.

The amount of dye which diffuses into the plastics layer of the receptor on heating is proportional to the optical density which was determined photometrically as absorbance A after each heating to the above-specified temperatures.

The plot of the logarithm of the measured absorbances A against the reciprocal of the corresponding absolute temperature is a straight line from whose slope it is possible to calculate the activation energy $\Delta E_T$ for the transfer experiment:

$$\Delta E_T = 2.3 \times R \times \frac{\Delta \log A}{\Delta\left[\frac{1}{T}\right]} \quad R\text{: general gas constant}$$

From the plot it is additionally possible to discern the temperature T* at which the absorbance attains the value 1, ie. at which the transmitted light intensity is one tenth of the incident light intensity. The lower the values of the temperature T*, the better the thermal transferability of the investigated dye.

The table which follows lists the anthraquinone dyes I which were tested in respect of their thermal transfer characteristics together with their absorption maxima $\lambda_{max}$ [nm] measured in methylene chloride.

The table also shows the particular binder B used. The abbreviations have the following meanings: EC=ethylcellulose, EHEC=ethylhydroxyethylcellulose, PVB=polyvinyl butyrate, MX=EC:PVB=2:1.

Other characteristic data listed are the aforementioned parameters T* [°C.] and $\Delta E_T$ [kcal/mol].

TABLE 1

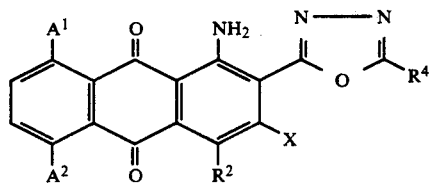

IIa'

| Example | $A^1$ | $A^2$ | $R^2$ | X | $R^4$ | $\lambda_{max}$ [nm] | B | T* [°C.] | $\Delta E_T$[kcal/mol] |
|---|---|---|---|---|---|---|---|---|---|
| 1 | —H | —H | —$NH_2$ | —H | —$C_6H_{13}$ | 620 | EC | 85 | 22 |
| 2 | —H | —H | —$NH_2$ | —H | —$(CH_2)_3$—$CH(C_2H_5)$—$C_4H_9$ | 620 | EC | 90 | 19 |
| 3 | —H | —H | —$NH_2$ | —H | —$(CH_2)_3$—O—$C_4H_9$ | 622 | EC | 79 | 20 |
| 4 | —H | —H | —$NH_2$ | —H | —$[(CH_2)_2$—$O]_3$—$C_4H_9$ | 619 | EC | 80 | 16 |
| 5 | —H | —H | —OH | —H | —$(CH_2)_4$—$CH(C_2H_5)$—$C_4H_9$ | 558 | MX | 96 | 17 |
| 6 | —H | —H | —S—Ph | —H | —$C_{12}H_{25}$ | 553 | EC | 92 | 18 |
| 7 | —H | —H | —$NH_2$ | —H | —S—$C_9H_{19}$ | 622 | EC | 98 | 24 |
| 8 | —H | —H | —NH—$C_4H_9$ | —H | —$[(CH_2)_3$—$O]_2$—$C_4H_9$ | 670 | EC | 89 | 17 |
| 9 | —H | —H | —$NH_2$ | —CN | —S—$(CH_2)_3$—O—$(CH_2)_4$—$CH(C_2H_5)$—$C_4H_9$ | 664 | EC | 98 | 15 |
| 10 | —$NH_2$ | —OH | —OH | —H | —S—$(CH_2)_4$—$CH(C_4H_9)$—$C_5H_{11}$ | 576 | EC | 96 | 20 |

TABLE 2

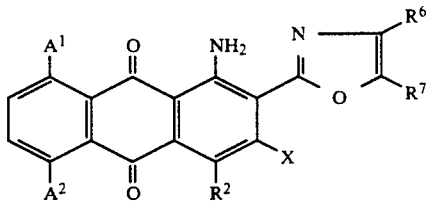

IId'

| Example | $A^1$ | $A^2$ | $R^2$ | X | $R^6$ | $R^7$ | $\lambda_{max}$ [nm] | B | T* [°C.] | $\Delta E_T$ [kcal/mol] |
|---|---|---|---|---|---|---|---|---|---|---|
| 11 | —H | —H | —NH—$C_6H_{13}$ | —H | —$CH_3$ | —CO—O—$C_6H_{13}$ | 655 | EC | 90 | 22 |
| 12 | —H | —H | —$NH_2$ | —H | —$CH_3$ | —CO—O—[$(CH_2)_2$—O]$_3$—$C_4H_9$ | 621 | EC | 80 | 16 |
| 13 | —H | —H | —$NH_2$ | —H | —$C_4H_9$ | —CO—O—[$(CH_2)_2$—O]$_3$—$C_3H_7$ | 622 | EC | 90 | 19 |
| 14 | —H | —H | —$NH_2$ | —CN | —$CH_3$ | —CO—O—$C_{11}H_{23}$ | 665 | EC | 90 | 17 |
| 15 | —H | —H | —NH—$C_5H_{11}$ | —CN | —$CH_3$ | —CO—O—$C_{10}H_{21}$ | 677 | EHEC | 96 | 23 |
| 16 | —H | —H | —NH—$C_4H_9$ | —CN | —$CH_3$ | —CO—O—[$(CH_2)_3$—O]$_2$—$C_4H_9$ | 675 | EC | 92 | 19 |
| 17 | —OH | —$NH_2$ | —OH | —H | —$CH_3$ | —CO—O—[$(CH_2)_3$—O]$_3$—$C_4H_9$ | 670 | EC | 92 | 17 |
| 18 | —NH—$C_4H_9$ | —$NH_2$ | —NH—$C_4H_9$ | —H | —$CH_3$ | —CO—O—[$(CH_2)_2$—O]$_3$—$C_4H_9$ | 700 | MX | 98 | 21 |

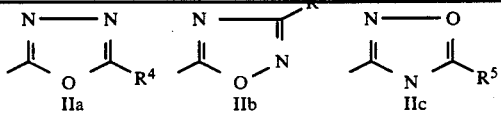

IIa IIb IIc

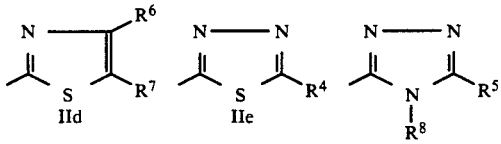

IId IIe IIf

TABLE 3

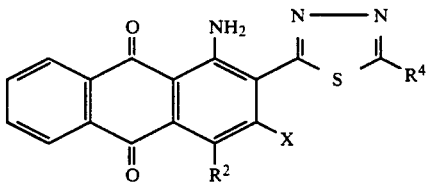

IIe'

| Example | $R^2$ | $R^4$ | $\lambda_{max}$ [nm] | B | T* [°C.] | $\Delta E_T$[kcal/mol] |
|---|---|---|---|---|---|---|
| 19 | —$NH_2$ | —$C_{10}H_{21}$ | 621 | EHEC | 82 | 17 |

We claim:

1. A process for thermotransfer printing, comprising transferring a transfer dye by diffusion from a transfer to a plastic coated substrate by applying heat from a heat source to the transfer, wherein the transfer dye is an anthraquinone dye of the general formula I

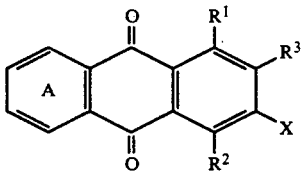

I in which the variables have the following meanings: the ring A may carry up to two of the following substituents: chlorine, bromine, hydroxyl, mercapto, amino or $C_1$–$C_8$-alkylamino, $R^1$ and $R^2$ are each hydrogen, nitro, hydroxyl, mercapto, amino or $C_1$–$C_{20}$-alkoxy, -alkylthio or -alkylamino whose carbon chain may in each case be interrupted by from 1 to 4 oxygen atoms and which may each carry the following substituents: $C_5$–$C_7$-cycloalkyl, phenyl or phenoxy, which may each carry $C_1$–$C_4$-alkyl or -alkoxy as substituents, phenoxy, phenylthio or phenylamino whose phenyl moiety may carry $C_1$–$C_4$-alkyl or -alkoxy as substituents, $R^3$ is one of the radicals of the formulae IIa to IIf where the substituents have the following meanings:

$R^4$ is hydrogen, $C_1$–$C_{20}$-alkyl or -alkylthio whose carbon chain may in each case be interrupted by from 1 to 4 oxygen atoms in ether function and which may carry the following substituents: $C_5$–$C_7$-cycloalkyl, phenyl or phenoxy, which may each carry $C_1$–$C_4$-alkyl or -alkoxy as substituents, $C_5$–$C_7$-cycloalkyl or -cycloalkylthio or phenyl which may each carry $C_1$–$C_4$-alkyl or -alkoxy as substituents, $R^5$ and $R^8$ are each hydrogen or alkyl, cycloalkyl or phenyl $R^4$ as defined, $R^6$ and $R^7$ are each $R^5$ or $R^8$, alkoxycarbonyl whose carbon chain may have up to 20 carbon atoms and which may be interrupted by from 1 to 4 oxygen atoms in ether function and which may carry the following substituents: $C_5$–$C_7$-cycloalkyl, phenyl or phenoxy, which may each carry $C_1$–$C_4$-alkyl or -alkoxy as substituents, $C_5$–$C_7$-cycloalkyloxy-carbonyl or phenoxycarbonyl which may each carry $C_1$–$C_4$-alkyl or -alkoxy as substituents, and X is hydrogen or cyano.

2. A process as claimed in claim 1 wherein said heat source is a thermal printing head.

3. A process as claimed in claim 1, wherein the anthraquinone dye used has the formula Ia

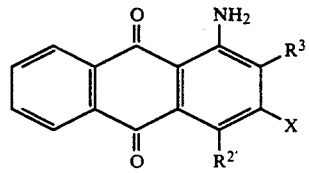

Ia where $R^{2'}$ is amino or $C_1$–$C_8$-alkylamino.

* * * * *